US008033545B2

(12) United States Patent
Prinz

(10) Patent No.: US 8,033,545 B2
(45) Date of Patent: Oct. 11, 2011

(54) METHOD AND CONTROL ARRANGEMENT FOR TRANSPORTING PRINTING MATERIAL

(75) Inventor: Matthias Prinz, Felde (DE)

(73) Assignee: Eastman Kodak Company, Rochester, NY (US)

( * ) Notice: Subject to any disclaimer, the term of this patent is extended or adjusted under 35 U.S.C. 154(b) by 213 days.

(21) Appl. No.: 10/586,433

(22) PCT Filed: Jan. 11, 2005

(86) PCT No.: PCT/EP2005/000170

§ 371 (c)(1),
(2), (4) Date: Nov. 26, 2008

(87) PCT Pub. No.: WO2005/068200

PCT Pub. Date: Jul. 28, 2005

(65) Prior Publication Data

US 2009/0066014 A1 Mar. 12, 2009

(30) Foreign Application Priority Data

Jan. 17, 2004 (DE) ..... 10 2004 002 645

(51) Int. Cl.
*B65H 7/02* (2006.01)

(52) U.S. Cl. ..... 271/258.01; 271/86; 271/165; 399/21

(58) Field of Classification Search ..... 271/303, 271/258.01, 258.02, 258.04, 65, 186; 399/21, 399/401, 22

See application file for complete search history.

(56) References Cited

U.S. PATENT DOCUMENTS

| | | | | |
|---|---|---|---|---|
| 4,285,508 | A | 8/1981 | Kaneko | |
| 4,344,614 | A | 8/1982 | Kaneko et al. | |
| 4,867,431 | A * | 9/1989 | Hosking et al. | 241/3 |
| 5,421,463 | A * | 6/1995 | Okazaki et al. | 209/559 |
| 6,102,393 | A * | 8/2000 | Kida et al. | 271/303 |
| 6,144,818 | A | 11/2000 | Ohtani | |
| 6,286,831 | B1 * | 9/2001 | Marasco et al. | 271/303 |
| 6,341,777 | B1 * | 1/2002 | Carter | 271/291 |
| 6,550,762 | B2 * | 4/2003 | Stoll | 271/186 |
| 2002/0011161 | A1 | 1/2002 | Jader et al. | |

FOREIGN PATENT DOCUMENTS

JP 58109338 6/1983

* cited by examiner

*Primary Examiner* — Stefanos Karmis
*Assistant Examiner* — Thomas Morrison
(74) *Attorney, Agent, or Firm* — Lawrence P. Kessler; Christopher J. White

(57) ABSTRACT

An object of the present invention is to improve the process sequence in a printing machine. Another object of the present invention is to increase the operational life of the printing machine. A method has been provided for transporting printing material (9) through a printing machine in which, in case of an occurrence of paper jam in the transport path (2), a flap (5) in the transport path (2) is actuated and a sheet of printing material (9) is transported along the flap (5) out of the transport path (2). Furthermore, a transport arrangement (1) for transporting printing material (9) along a transport path (2) in a printing machine is provided, comprising at least one transport path flap (5) actuated by a control arrangement (20) for opening and closing, and comprising an associated container (8) for receiving waste printing material when said flap (5) is open.

9 Claims, 2 Drawing Sheets

METHOD AND CONTROL ARRANGEMENT FOR TRANSPORTING PRINTING MATERIAL

The present invention relates to a method and apparatus for transporting printing material (9) through a printing machine, along a transport path (2) including a flap (5) and a plurality of switches (42, 43) associated with such transport path (2), and recovering from a printing material jam in the transport path (2).

Many different arrangements for transporting printing material are known in the field of printing machines. Widespread are continuous transport belts, which carry printing material, and transport rollers, which roll off the printing material and exert a frictional force on the printing material in transport direction. The path taken by a printing material, for example a sheet of paper, through the printing material is referred to as the paper path or the transport path and represents a substantial operational part of the printing machine. Malfunctions related to the transport of the printing material are inevitable; these are, for example, paper jams in the transport path, in which case the printing material is undesirably stopped by parts of the printing machine and not transported further. These malfunctions frequently require the operator's intervention which involves stopping of the printing job and opening the housing of the printing machine. The jammed printing material is removed manually, and the printing job is continued or restarted. In another method for trouble-shooting a paper jam, the sheet still in the transport path is ejected, and then the printing job is resumed. Also in this case, manual intervention is frequently necessary. Also known are changeable switches which change the transport path of the printing material and, when printing material is still jammed in the printing machine, redirect it to a waste container. However, these switches do not guide printing material out of the printing machine, when this printing material is in the switches itself at the time of the paper jam and the subsequent stop period of the printing machine.

An object of the present invention is to improve the process sequence in a printing machine.

Another object of the present invention is to increase the operational life of the printing machine.

In accordance with the invention, these problems have been solved by the features of Claims 1 and 9.

The ejection of excess printing material is made possible in particular, even if this material is stuck at one of these switches of the transport path. The time required for returning the printing machine back into operational state is much shorter. Trouble-shooting of problems relating to the printing material transport is minimized.

Developments of the invention are described in the subclaims.

Figure 1:
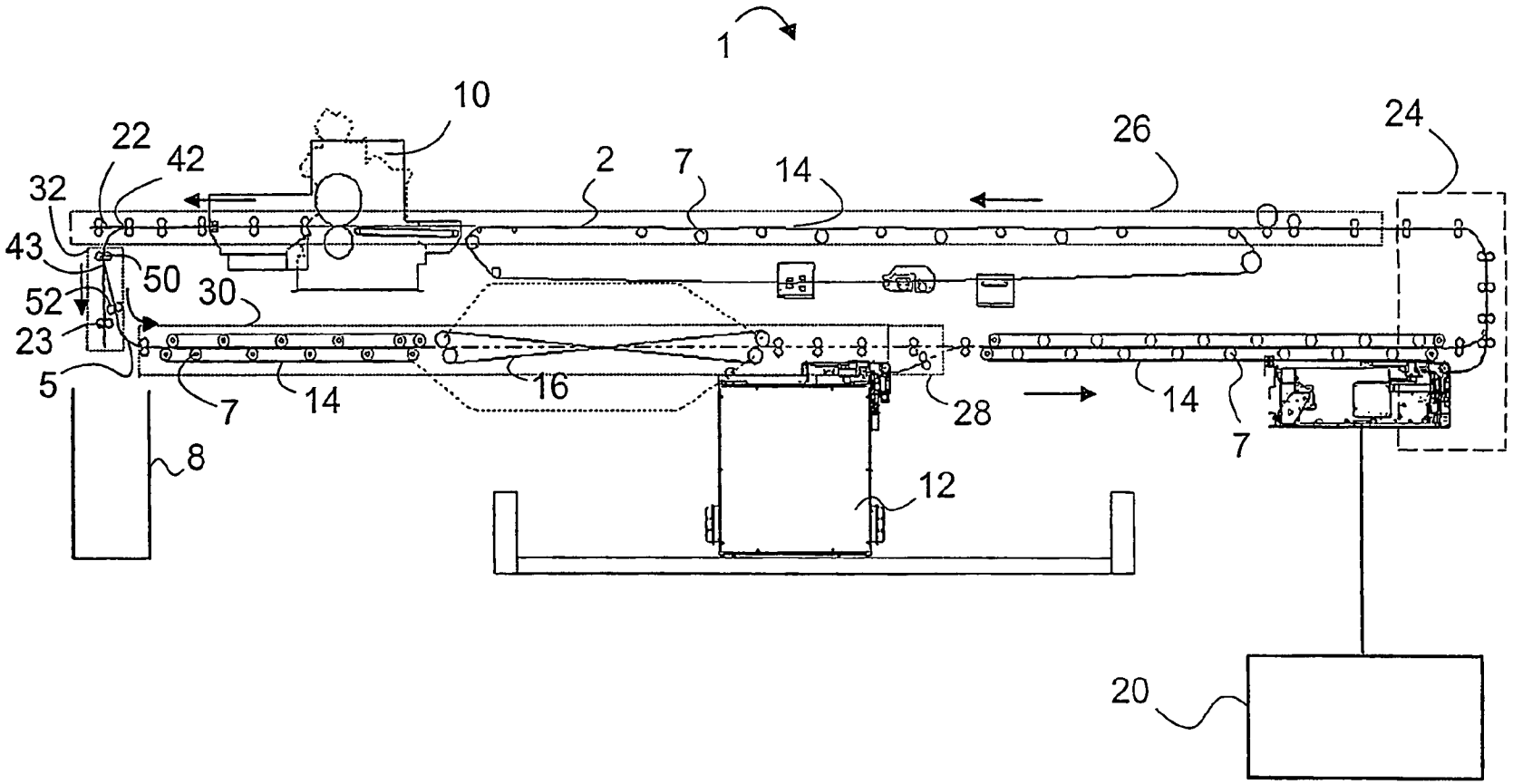
Figure 2A:
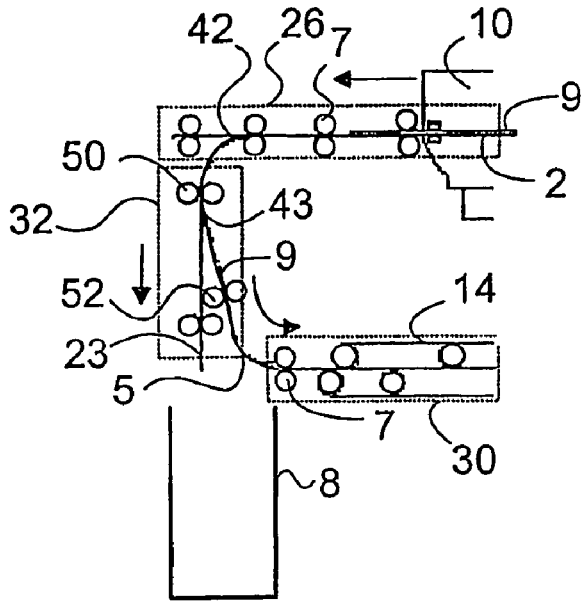
Figure 2B:
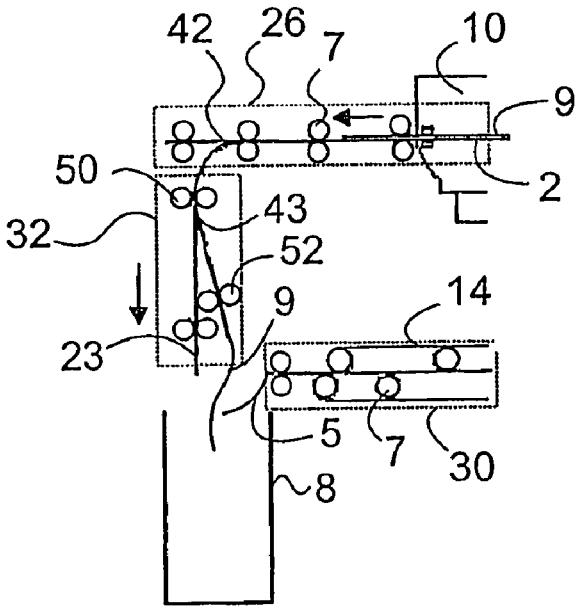

Hereinafter, embodiments of the invention are described with reference to drawings. They show:

FIG. 1 a schematic side elevation of a transport arrangement of a printing machine with a transport path for controlling the transport of printing material;

FIG. 2*a* a section of a transport path as in FIG. 1 with a controlled flap in closed state;

FIG. 2*b* a section of a transport path as in FIG. 1 with a controlled flap in open state.

FIG. 1 shows a schematic side elevation of a transport arrangement 1 of a printing machine with a transport path 2 in open state. The unprinted printing material 9 is held available in at least one paper container 12 and is fed from said container to transport path 2. Printing material 9, in this case one sheet of paper, is advanced in the direction of the arrows over several transport arrangements which make up transport path

2 of the printing machine. Transport path 2 guides printing material 9 past the known operational parts of the printing machine, for example, the imaging arrangement and the fusing arrangement 10, and comprises several driven continuous belts 14, a plurality of driven rollers 7, a first exit 22 for depositing the printed printing material 9 on a paper support or a paper tray, and a second exit 23 to a container 8 for receiving waste printing material 9. Upstream of the first exit 22 is a first switch 42 which can be thrown controlled by control arrangement 20 and which determines the direction of the transport path 2, i.e., said switch determines the direction in which printing material 9 is transported. In a first position of the first switch 42, printing material 9 is continued to be transported in transport path 2; in a second position of the first switch 42, printing material 9 is transported to the first exit 22. Furthermore, upstream of the second exit 23 of transport path 2, a second switch 43 which can be controlled by control arrangement 20 determines the direction of transport path 2, i.e., said switch determines in which direction printing material 9 is transported. In a first position of the second switch 43, printing material 9 is continued to be transported in transport path 2; in a second position of the second switch 43, printing material 9 is advanced to a second exit 23. Rollers 7 are arranged along transport path 2; however, for better representation, these are provided only with reference codes as an example. Furthermore, a flipping arrangement 16 is provided which flips printing material 9 and which is part of transport path 2. Flipping arrangement 16 flips printing material 9 if a second printing, a printing of the reverse side of the sheet, is to be carried out. The sheet is then again fed to the imaging process in the upper region of transport path 2. In simplex-printing, as a rule, printing material 9 is fed, after printing the front side, to the first exit 22 of the printing machine and deposited. To achieve this, prior art has provided a controllable element on transport path 2, namely a controllable switch 42, which, accordingly, guides printing material 9 to the first exit 22. The reverse side of printing material 9, in reversed position of the first switch 42, passes the first exit 22 and is guided to the lower region of transport path 2, flipped by flipping arrangement 16, and the unprinted reverse side, i.e., the side to be perfected, is printed. The printing machine is activated by schematically illustrated control arrangement 20, and, for example, comprises an external computer system to be operated by an operator. If the transport along transport path 2 is interrupted, for example, by a paper jam, the following situations may occur. The first situation to be viewed is simplex-printing, i.e., printing material 9 is printed on its front side. In a first region 24 of transport path 2 in the right region of FIG. 1, framed in dashed lines, a paper jam occurs which is detected by sensors in this first region 24. Said sensors report the paper jam in the first region 24 to control arrangement 20. As a result, control arrangement 20 activates the printing machine in such a manner that the drives of first region 24 are stopped and that the transport of printing material in the first region 24 is discontinued. In the second region 26, framed in dashed lines, the transport arrangements for transporting printing material 9, i.e., the drives with rollers 7, are continued to be operated despite the paper jam in the first region 24. Printing material 9 is transported in the second region 26 of transport path 2 and the printing job is continued as far as the sheets of printing material 9 still located in the second region 26 are concerned. The controllable element of the first exit 22 of transport path 2, i.e., the first switch 42, which determines the path taken by printing material 9 at the first exit 22, is activated by control arrangement 20 in such a manner that printing material 9 is guided out through the first exit 22 and leaves transport path 2 to a tray in which the sheets are deposited in an ordered manner. The sheets of printing material 9 which are located in the second region 26 of transport path 2, consequently, are continued to be processed and finished in the usual manner. The paper jam is eliminated by the operator, usually by hand, and control arrangement 20 subsequently controls all the drives in such a manner that the printing material transport is continued. In the next situation that is viewed, the printing machine is operated in duplex mode, i.e., both sides of printing material 9 are printed. In a third region 28 of transport path 2 downstream of paper container 12, framed in dashed lines, where printing material 9 is fed to the printing machine, a paper jam has occurred. This paper jam is detected by at least one sensor in the third region 28 of transport path 2. Inasmuch as, in duplex-printing, printing material 9 is not transported out through first exit 22 for deposit after the first page, i.e., the front page, has been printed but is transported along the curved arrow in the left region as in FIG. 1, and is fed to the lower region of transport path 2, there is the risk that printing material 9 is transported to the paper jam, thus causing additional undesirable paper jams. In a fourth region 30, which comprises the third region 28, framed in dashed lines and arranged upstream of the latter, the drives are stopped by control arrangement 20, and printing material 9 is not transported further in the fourth region 30. In all the other regions of transport path 2, viewed downstream of the paper jam in transport direction, the drives of transport path 2, comprising rollers 7 for transporting the sheets and driving transport belts 14, are continued to be driven. When the sensors have detected a paper jam, control arrangement 20 additionally opens a flap 5 in a fifth region 32 of transport path 2, which said flap, in closed position, forms a part of transport path 2, along which printing material 9 is transported, and in open position, clears transport path 2 so that a sheet of printing material 9 can be removed from transport path 2. Therefore, by opening flap 5, transport path 2 is opened; a gap is formed on transport path 2 which is covered when flap 5 is in closed position. On one side, flap 5 is rigidly connected with the subsequent part of transport path 2 and can be pivoted about this side. The other non-connected side of flap 5 can be pivoted in downward direction. Transport path 2 is interrupted and opened by the pivoting action of flap 5. Specifically, control arrangement 20 controls a solenoid by means of which flap 5 is actuated in the fifth region 32. Transport rollers 50 upstream of flap 5 are continued to be operated when flap 5 is in open position, and transport the sheet out of transport path 2 to container 8 located below transport path 2 when flap 5 is in open position. Container 8 is designed for accommodation of a plurality of waste sheets. The number of sheets of printing material 9 transported through opened flap 5 into container 8 is the number required for permitting reversal of switch 42 and switch 43, so that the sheets will reach exits 22 and 23, respectively. Each of switches 42, 43 can be reversed as soon as switches 42, 43 are no longer covered by a sheet of printing material 9; otherwise the sheets block switches 42, 43. Printing material 9 downstream of the paper jam, viewed downstream of the third region 28 in transport direction, is transported by the printing machine and leaves transport path 2, either through the second exit 23 to container 8 if only the front side of printing material 9 has been printed so far, or through the first exit 22 to the tray if both the front side and the reverse side have been printed. When the last sheet downstream of the paper jam has left transport path 2, a person operating the printing machine can eliminate the paper jam in the third region 28 and close flap 5 by hand. After flap 5 has been pivoted back and closed, transport path 2 is closed and again uninterrupted. Then the drives in the fourth region 30 of transport path 2 are again driven by control arrangement 20, and printing material 9 in the fourth region 30 is transported by the printing machine and leaves transport path 2 through the second exit 23 to container 8. Then the printing machine is again fully operational. The above-described operation will be specifically described with reference to FIGS. 2*a* and 2*b*.

FIG. 2*a* shows the left section of transport path 2 as in FIG. 1, the fifth region 32 of transport path 2. Flap 5 is shown closed and forms a part of transport path 2 along which the sheet of printing material 9 is moved in duplex-printing mode, i.e., to be printed on both sides, in order to be able to be printed on the other side during a renewed pass. In this example, all the rollers 7, 50, 52 are driven and transport the sheet along transport path 2 through the printing machine in the direction of the curved arrow and the fourth region 30 which is partially shown in FIG. 2*a*.

FIG. 2*b* shows a section of transport path 2, as in FIG. 1. Here, a transport problem has occurred with respect to printing material 9, said problem preventing the continuous operation of the printing machine. The driving arrangements of the printing machine are stopped selectively by control arrangement 20 as described above. Rollers 7, 50, 52, shown in FIG. 2*b*, are continued to be driven, specifically transport rollers 50, 52 in the fifth region 32, which comprises flap 5. In contrast, rollers 7 located downstream of flap 5, viewed in transport direction, are stopped. All the drives located upstream of the paper jam are stopped by control arrangement 20; the drives located downstream of the paper jam continue to be activated and operated. When a paper jam has been detected by the sensor arrangements on trans-port path 2, flap 5 is pivoted by control arrangement 20 is such a manner that trans-port path 2 is interrupted and opened again, as shown in FIG. 2*b*. As a result of this, printing material 9 is no longer fed to the lower fourth region 30 of transport path 2 comprising flipping arrangement 16, but said sheet is transported past said flipping so arrangement by transport rollers 50, 52, with flap 5 opened in the direction of container 8 and deposited there as waste. In so doing, container 8 acts as a receptacle for waste, from the printing machine, i.e., for material which can essentially not be reused. All sheets of printing material 9, located upstream of the paper jam and so far having been printed only on the first side of printing material 9, are transported into container 8. Only as many sheets of printing material 9 are transported through opened flap 5 into container 8 as are necessary to permit reversing the second switch 43 for the second exit 23. The second switch 43 is reversed as soon as the second switch 43 is no longer covered by printing material 9, and the following sheets of printing material 9 are fed to container 8 through the second exit 23. It is important that the sheet of printing material 9 be transported into container 8 even when the sheet is already in transport path 2 at flap 5, as shown by FIG. 2*a*. This is achieved by the combined action of additionally driven transport rollers 50, 52 and the special embodiment of flap 5, which is firmly mounted to one side of transport path 2 and which can be pivoted about said side. In so doing, transport rollers 50, 52 usually are rollers 7 of transport path 2 of the printing machine. Without the aforementioned features, sheets which are at flap 5 cannot be removed from transport path 2. A switch, as provided by prior art, is not adequate for this purpose because a sheet located at switch 42, 43 cannot be transported out of transport path 2 but is transported in the direction of the fourth region 30, as in FIG. 1, and the paper jam, if operation is continued. All those sheets of printing material 9, which are located downstream of the paper jam and which have already been printed on both the front and the reverse sides are transported to the first exit 22. When all the sheets down-stream of the paper jam have been transported out and the paper jam has been removed by the operator of the printing machine, flap 5 is closed by the operator and said flap assumes its original position, as shown by FIG. 2*a*, the operator then clears the printing machine to continue the printing operation. In so doing, the drives is the fourth region 30 of transport path 2 are again driven by control arrangement 20, and printing material 9 in the fourth region 30 is transported through the printing machine and leaves transport path 2 through the second exit 23 to container 8. The printing process is continued, in that printing material 9 is fed from paper containers 12 to transport path 2.

LIST OF REFERENCE NUMBERS

1 transport arrangement
2 transport path
5 flap
9 printing material
7 rollers
8 container
10 fusing arrangement
12 paper container
14 transport belts
16 flipping arrangement
20 control arrangement
22 first exit
23 second exit
24 first region
26 second region
28 third region
30 fourth region
32 fifth region
42 first switch
43 second switch
50, 52 transport rollers

The invention claimed is:

1. A printer for printing on a print media operable in at least a duplex-printing mode, the printer comprising:

(a) a transport path for transporting the print media for printing;

(b) a control arrangement for activating the printer and directing the print media through the printer;

(c) a jam sensor for detecting a paper jam;

(d) a first switch for directing the print media through a first exit to a receiving receptacle not within the transport path or for permitting the print media to continue on the transport path; wherein when the printer is in duplex-printing mode and a paper jam is detected, the first switch transports the print media in which duplex-printing is complete out of the transport path via the first exit to the receiving receptacle and the print media in which only one side of the print media has been printed continues through the transport path;

(e) a flap for transporting the print media through a second exit to a container not within the transport path or permitting the print media to continue on the transport path; wherein when the printer is in duplex-printing mode and a paper jam is detected, the flap passes the print media in which only one side of the print media has been printed out of the transport path via the second exit to the container; and (f) a flipping arrangement disposed within the transport path for flipping the print media for permitting printing on a second side of the media.

2. The printer as in claim 1, the printer being further operable in a simplex-printing mode, wherein the first switch exits the print media out of the first exit when in simplex-printing mode or when duplex-printing is complete or continues transporting the print media through the transport path when in duplex-printing and printing on a first side is complete and printing on a second side is incomplete.

3. The printer as in claim 2, wherein second switch receives the print media in which, when in duplex-printing, one side of the print media has been printed and is continuing for printing on the second side.

4. The printer as in claim 1 further comprising a solenoid for actuating the flap.

5. The method as in claim 1, wherein the receiving receptacle is a paper tray.

6. A method for printing on print media using a printer, the method comprising the steps of:

(a) directing the media through a transport path using a control arrangement;

(b) detecting a paper jam in the transport path;

(c) transporting the print media through a first exit to a receiving receptacle not within the transport path or continuing to transport the print media on the transport path; wherein when the printer is in duplex-printing mode and the paper jam is detected, transporting the print media in which duplex-printing is complete out of the transport path via the first exit to the receiving receptacle and the print media in which only one side of the print media has been printed continues through the transport path;

(d) transporting the print media through a second exit to a container not within the transport path or continuing to transport the print media on the transport path; wherein when the printer is in duplex-printing mode and the paper jam is detected, transporting the print media in which only one side of the print media has been printed out of the transport path via the second exit to the container; and (e) providing a flipping arrangement disposed within the transport path for flipping the print media for permitting printing on a second side of the media.

7. The method as in claim 6 further comprising the step of providing a flap for performing step (c).

8. The method as in claim 7 further comprising the step of providing a solenoid for actuating the flap.

9. The method as in claim 6, wherein the receiving receptacle is a paper tray.

* * * * *